US005154034A

United States Patent [19]

Stanek

[11] Patent Number: 5,154,034

[45] Date of Patent: Oct. 13, 1992

[54] MUNTIN BAR STABILIZER WITH PAD AND METHOD OF STABILIZING

[76] Inventor: Ronald F. Stanek, 6707 Thorton Dr., Parma, Ohio 44129

[21] Appl. No.: 640,138

[22] Filed: Jan. 11, 1991

[51] Int. Cl.[5] ..... E04B 1/61

[52] U.S. Cl. ..... 52/766; 52/456; 52/656; 52/665; 403/84

[58] Field of Search ..... 52/766, 767, 768, 776, 52/456, 457, 458, 314, 656, 455, 665; 403/84, 85

[56] References Cited

U.S. PATENT DOCUMENTS

| | | | |
|---|---|---|---|
| 2,083,409 | 6/1937 | Stevens | 52/456 |
| 3,307,316 | 3/1967 | Gray | 52/665 |
| 3,485,519 | 12/1969 | Chiu | 52/665 X |
| 3,645,058 | 2/1972 | Jacobson et al. | 52/456 |
| 3,791,095 | 2/1974 | Martin | 52/456 X |
| 3,829,226 | 8/1974 | Kreusel | 52/656 X |
| 3,866,380 | 2/1975 | Benson | 52/656 |
| 4,145,858 | 3/1979 | Dovman | 52/456 |
| 4,723,388 | 2/1988 | Zieg | 52/665 |

*Primary Examiner*—David A. Scherbel
*Assistant Examiner*—Kien Nguyen
*Attorney, Agent, or Firm*—Fay, Sharpe, Beall, Fagan, Minnich & McKee

[57] ABSTRACT

A stabilizer for securing muntin bar within insulating glass windows has a primary insert, a secondary insert, and a pad which is attached to the primary insert by an attaching means. The primary and secondary inserts are insertible into open ends of muntin bar to secure the two ends into a desired angle. The secondary insert is attached to the primary insert by means of a pivot, allowing the same stabilizer to be used for a variety of angles. The pad is adjustable allowing it to fit against an associated spacer bar and secure the muntin bar between the panes of the insulating glass window.

20 Claims, 3 Drawing Sheets

MUNTIN BAR STABILIZER WITH PAD AND METHOD OF STABILIZING

BACKGROUND OF THE INVENTION

1. Field of Invention

This invention pertains to the art of insulating glass windows featuring decorative muntin bar arrangements located between the panes of the insulating glass window, and more particularly to the devices inserted into the ends of the muntin bars to secure them between the panes of the insulating glass window.

2. Description of the Related Art

It is known in the art to insert devices into the muntin bars to secure them within insulating glass windows. It is known to manufacture these devices out of nylon to prevent discoloration and clouding of the glass.

While some of these devices perform adequately, the installation and assembly time into the muntin bars themselves is significant. For some arrangements, such as, a diamond-shaped muntin bar, the cost of assembly was significantly more than the cost of material's and made the cost of windows in some cases prohibitive. Because of the variety of angles present in a diamond-shaped muntin arrangement, a variety of inserted devices are needed. Some devices tend to work adequately with one angle and poorly with another angle. Some devices require trimming if they are used in a single end of the muntin bar, rather than at a juncture of two such bars which join to form an angle.

A significant drawback in the prior art was the requirement that a pad be attached directly to the muntin and not the inserted device before the muntin bar arrangement was inserted into the insulating glass window. The function of the pad is to stabilize the muntin bar arrangement between the panes of the window without rattling. A second function of the device is to help brace the individual muntin bars in the arrangement against the spacer bar adjacent it. The function of the inserted device is to stabilize the junction of two muntin bars into the desired angle. A prior art method includes inserting devices into the muntin bars and applying a silicon adhesive to the juncture. The muntin bar and inserted devices were then secured together, such as by clothespins, and allowed to dry for up to 48 hours. At this point, the muntin bar could be fitted with pads and inserted into the insulating glass window. The pads needed to be fitted and cut to each angle so as to lay flat against the spacer bar within the insulating glass window.

The present invention contemplates a new and improved stabilizing device which is simple and inexpensive in design and manufacture, yet overcomes the foregoing difficulties and others while providing better and more advantageous overall results.

SUMMARY OF THE INVENTION

In accordance with the present invention, a new and improved insert is provided which is adapted to be inserted within open ends of the muntin bar.

More particularly, in accordance with the invention, the stabilizer includes a primary insert having a first and second end. A secondary insert also has first and second ends, with the first end of the secondary insert being connected to the first end of the primary insert. A pad is attached to the first end of the primary insert via attaching means. The orientation of the pad is adjustable within a range of substantially 360° in the plane of the muntin bar.

According to another aspect of the invention, the attaching means is a neck which is more easily deformable in the plane of the associated muntin bar than in other directions. The neck is generally plastically deformable so that the pad tends to retain, at least temporarily, the position to which it has been deformed.

According to another aspect of the invention, the second end of the primary insert comprises a pair of bowed legs. Each bowed leg has a knee which, when inserted within a piece of associated muntin bar, presses against the interior of the associated muntin bar, thereby securing the stabilizer within the muntin bar.

According to another aspect of the invention, the first end of the primary insert has a pivot hole and the first end of the secondary insert has a pivot post. The pivot post is rotatably received within the pivot hole. The pivot post terminates in a ledge which is selectively receivable within a slot in the pivot hole.

According to another aspect of the invention, a nylon stabilizer for securing the muntin bar within insulating glass windows comprises a body having a first end and a second end. The second end has insertion means for securing the body within an associated muntin bar. A pad is attached to the first end of the body via attaching means. The first end of the stabilizer features a flat face making an angle between 10° and 45° with a longitudinal axis of the stabilizer. The pad lies in a plane which is parallel to this flat face. The insertion means comprises a pair of outwardly extending legs, each of which has a knee and a toe. The toes extend less outwardly than the knees and are arrow-shaped to aid in the insertion of the stabilizer within the muntin bar. The attaching means is a neck which has a thickness of about 0.030 inches.

According to a still further aspect of the invention, a method of manufacturing variously sized stabilizers for securing muntin bars within variously dimensioned insulating glass windows comprises the steps of molding the stabilizer, the stabilizer having a pad with a width equal to the largest space between panes of an associated insulating glass window into which the muntin bars might possibly be inserted, loading the stabilizer into a jig, and cutting the pad to the actual width equal to the space between the panes of the specific insulating glass window into which the stabilizer and muntin bar will actually be inserted.

According to a still further aspect of the invention, a method of assembling muntin bar for placement within insulating glass windows comprises the steps of fixing individual pieces of muntin bar into the desired arrangement, inserting a stabilizer within an end of the muntin bars which will eventually lie adjacent an associated spacer bar, and adjusting the orientation of each pad so that it lies parallel and adjacent to the portion of the spacer bar to which it will be adjacent upon insertion of the muntin bar within the window.

According to a still further aspect of the invention, a method of assembling muntin bar into a diamond-shaped arrangement for placement within insulating glass windows comprises the steps of fixing the individual pieces of muntin bar into a diamond-shaped arrangement, inserting a stabilizer assembly into each large angle junction of the muntin bars, the stabilizer assembly comprising a primary and secondary insert with an adjustable pad adjustably fixed to one end of the primary insert, inserting a stabilizer assembly into each small angle junction of the muntin bars, inserting a primary insert into each single end of the muntin bar, and adjusting the angle of each pad so that it lies parallel to the portion of the spacer bar to which it will be adjacent upon insertion of the muntin bars within the window.

One advantage of the present invention is that the stabilizer assembly, comprising primary and secondary inserts, can fit every angle of a diamond-shaped muntin bar design without trimming.

Another advantage of the present invention is that the stabilizer assembly can be separated so that the primary insert alone may be inserted into a single end of muntin bar and provide good stabilizing without need for another part.

Another advantage of the present invention is ease and efficiency in manufacture and assembly of the muntin bar arrangement, since the primary and secondary inserts are the same size for every dimension of insulating glass window. The only part which may need to be cut to fit a specific design consideration is the pad. The pads are made of thin flat material and are easily cut.

Another advantage of the invention is that the pad is fixed to the primary and secondary insert. Prior art designs did not feature such an arrangement. This reduces the amount of time necessary to assemble the muntin bar and insures proper placement of the pad against the spacer. The pad is initially angled at 30° to the longitudinal centerline of the primary insert. The applicant has found this to be a preferred angle to allow correct placement of the pad against the spacer bar.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings, which form a part hereof and wherein.

DESCRIPTION OF THE PREFERRED EMBODIMENT

Figure 1:
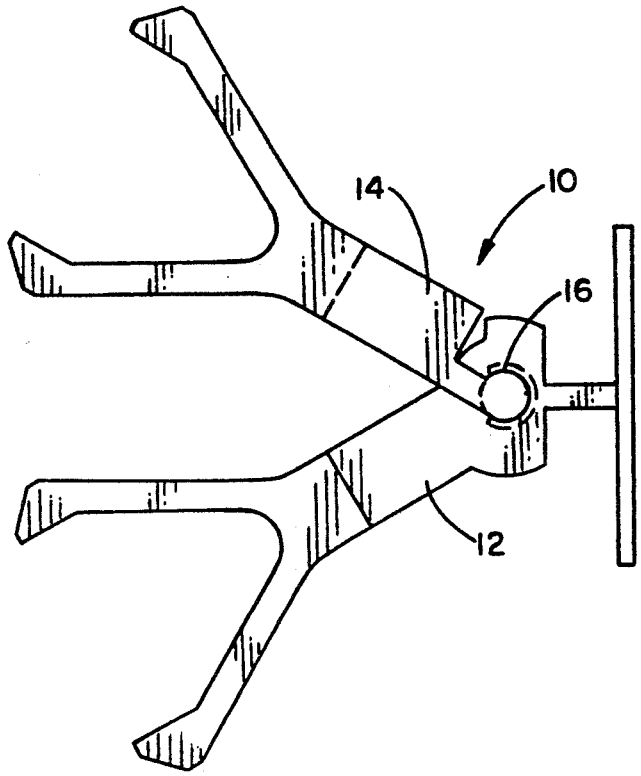
FIG. 1 is a top plan view of a stabilizer assembly comprising a primary insert and a secondary insert rotatably fixed together.

Referring now to the drawings, wherein the showings are for purposes of illustrating a preferred embodiment only, and should not be construed as limiting the invention, FIG. 1 shows a stabilizer 10 according to the invention. The stabilizer 10 comprises primary insert 12 and secondary insert 14. The secondary insert 14 is selectively fixed to the primary insert through a pivot point 16.

Figure 2:
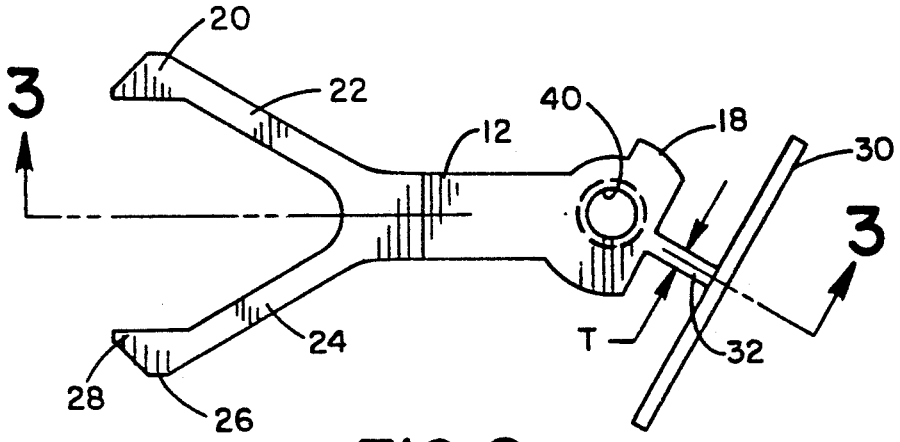
FIG. 2 is a top plan view of a primary insert according to the present invention.

With reference to FIG. 2, primary insert 12 has a first end 18 and a second end 20, and a longitudinal centerline CL. The second end 20 comprises a pair of bowed legs 22, 24. Each bowed leg 22, 24 has a knee 26 and a toe 28. The knees 26, when inserted within a piece of associated muntin bar, press outwardly against the interior surface of the muntin bar and help secure the primary insert 12 within the muntin bar. The toes 28 are shaped somewhat like an arrow and do not extend outwardly as far as the knees 26. This configuration aids in the insertion of the primary and secondary inserts 12, 14 into the associated muntin bar.

Figure 3:
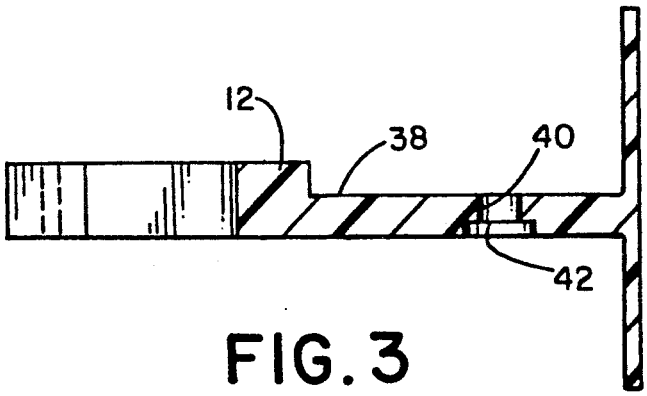
FIG. 3 is a side cross-sectional view of the primary insert of FIG. 2 taken along line A—A.

With reference to FIGS. 2 and 3, attached to the first end 18 of the primary insert 12 is a pad 30. The pad is attached via neck 32. The thickness T of the neck 32 is significantly less than the width W of the neck 32. In the preferred embodiment, the thickness T is equal to approximately one half the width W. In the preferred embodiment, T is equal to 0.035 inches while W is equal to 0.059 inches. This contributes to stability in one direction and deformability in another. The neck 32 is easily deformed within the plane of the muntin bar as shown in FIG. 2. The preferred material of the stabilizer 10 is nylon 6/6. This material, when molded at appropriate dimensions, provides for ease of deformability and does not react detrimentally with other components of the insulating glass window. Other materials which can be used are nylon type 6/10, nylon type 6/12, (filled and unfilled), PVC, UPVC, acetal polyethylene, polypropalene, steel, aluminum, zinc, or alloys.

The pad 32 tends to remain in the deformed position after deformation. This is an advantage when constructing the muntin bar arrangement, since the pad can be deformed to the desired location and expected to remain in the deformed position.

With continuing reference to FIG. 3, a step off 38 is shown. The step off 38 is equal to about ½ the thickness of the bowed legs 22, 24. The step off 38 contributes to ease of rotation of the secondary insert 14 about pivot point 16 by providing space for movement by the secondary insert 14.

With reference to FIG. 2 and FIG. 3, a pivot hole 40 is disclosed. The pivot hole 40 features a slot 42 on the opposite side of the primary insert 12 as the step off 38. The width of pad 30 is designated S. The dimension S is adjusted so that it is equal to the amount of space between the panes of an insulating glass window. While the primary insert 12 could be molded so that the dimension 8 of pad 30 exactly fits the particular spacing required in a particular application, it is preferred to choose the distance s to be the largest spacing for which a stabilizer 10 might be needed. If a smaller spacing is to be used in the window, requiring a smaller dimension S for the pad 30, the pad 30 can be easily cut by a variety of manufacturing methods known in the art. In the preferred method, a plurality of stabilizers 10 are molded so that the width of the pad 30 equals the largest dimension S which might be required. A plurality of molded stabilizers 10 are loaded into a jig which positions the pad 30 so that each side rests on an anvil. In a single downward stroke, such as by a press fitted with appropriate tools, all pads 30 are trimmed to a desired width. This process is less costly than designing a series of molds for each dimension S which might be required.

Figure 4:
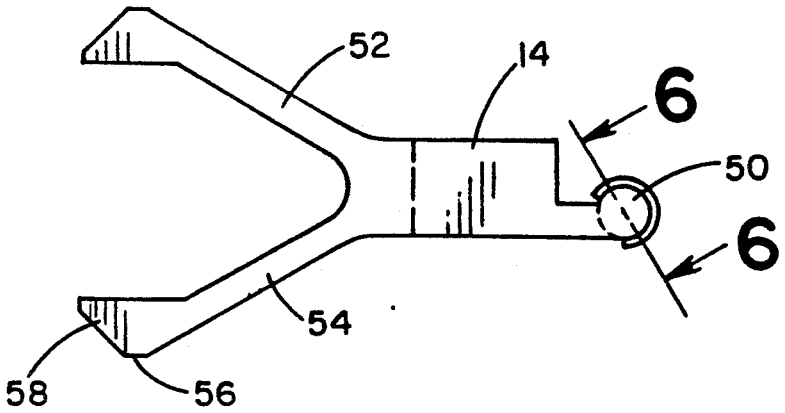
FIG. 4 is a top plan view of a secondary insert according to the invention.
Figure 5:
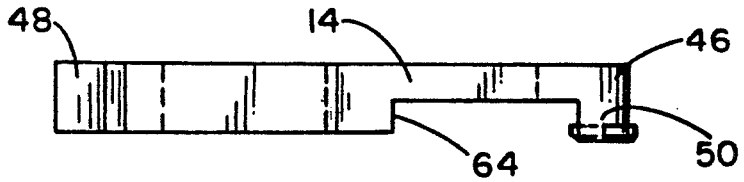
FIG. 5 is a side plan view of a secondary insert according to the invention.

With reference to FIG. 4 and 5, secondary insert 14 is shown. The first end 46 of the secondary insert 14 features a pivot post 50. The second end 48 of the secondary insert 14 features bowed legs 52, 54, knees 56, and toes 58 similar to those of the primary insert 12. A step off 64 is equal to approximately ½ the thickness of the bowed legs 52, 54. This step off 64 cooperates with the step off 38 previously discussed and shown in FIG. 3 to allow for rotatability of the secondary insert 14 about pivot point 16.

Figure 6:
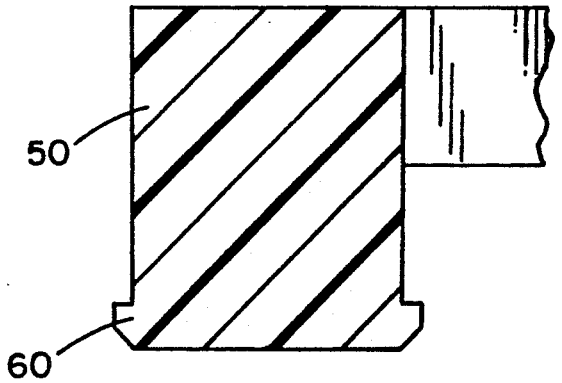
FIG. 6 is a cross-sectional view of a pivot post taken along line A—A of FIG. 4; and, FIG. 7 is a schematic representation of a diamond-shaped muntin bar pattern within an insulating glass window partially broken away to show the orientation of the stabilizers within the muntin bar.

With reference to FIG. 6, a cross-sectional enlarged view of pivot post 68 is shown. One end of the pivot post 50 features a ledge 60. The ledge is selectively receivable into the slot 42 of pivot hole 40 in the primary insert 12. The ledge 60 and slot 42 cooperate to secure the secondary insert 14 to the primary insert 12 while allowing rotatability through pivot point 16.

Figure 7:
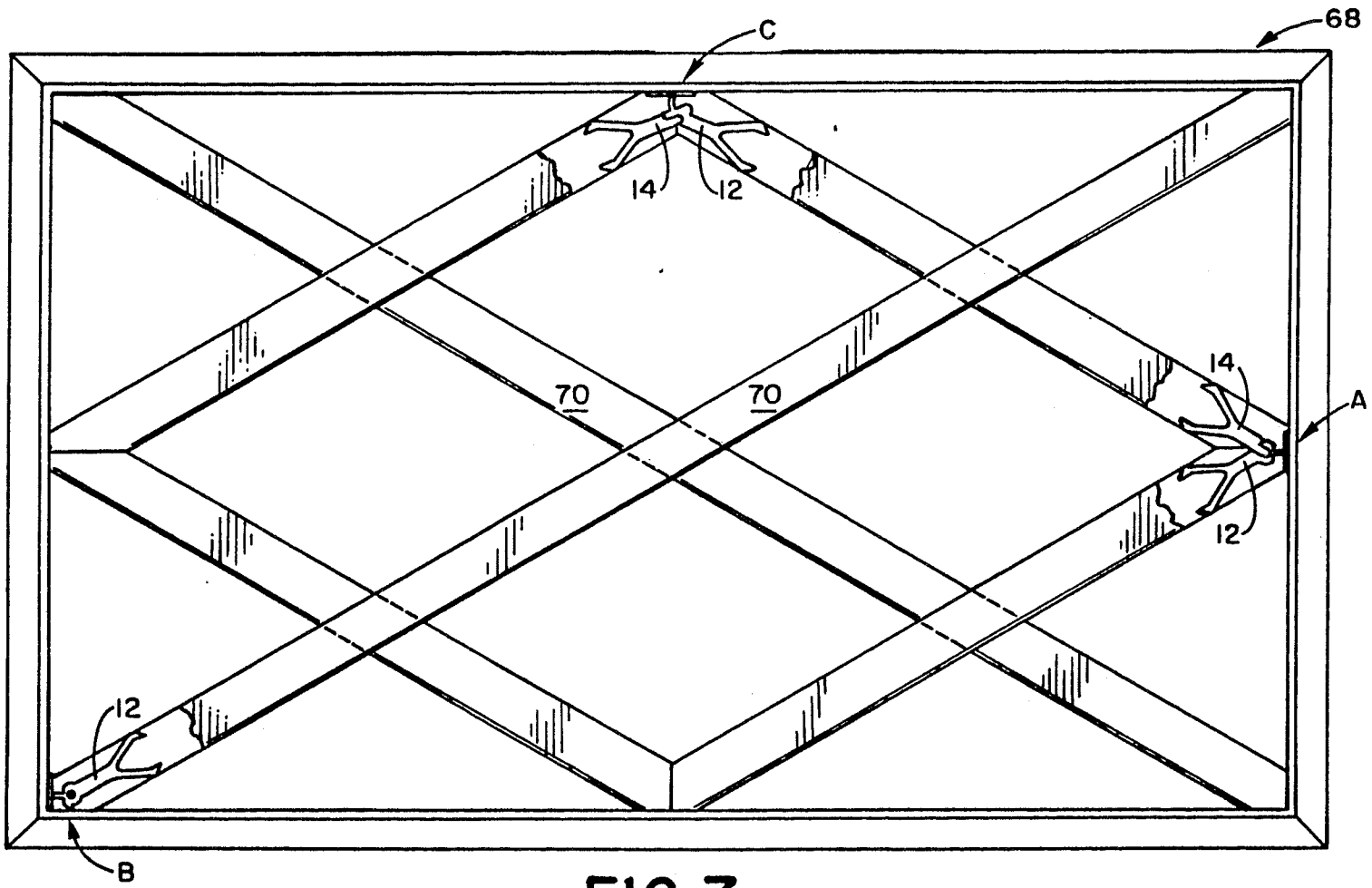

With reference to FIG. 7, a schematic insulating glass window 68 is shown. The window 68 has a depth X which represents the distance between the panes of the insulating glass window 68. In a typical insulating glass window, a spacer bar (not shown) separates the two panes of glass from each other a prescribed amount. This space is filled with a gas, such as argon, and provides excellent insulation. In the case where a decorative muntin bar arrangement 70 is desired, it can be inserted within the panes of the insulating glass window 68 during construction. One of the requirements of such a design is that the muntin bar arrangement 70 be securely fixed within the panes of the insulating glass window 68. One method of accomplishing this is to provide an insertible device into the muntin bar 70 to fix the orientation of the various bars relative to each other. A second procedure is to attach some sort of a spacer pad to the inserted device to keep the muntin bar 70 from rattling within the insulating glass window 68. Ideally, the width of the pad should be equal to the distance between the panes of the window.

Problems have arisen when utilizing certain designs of muntin bar 70 within insulating glass windows. For example, in the diamond-shaped arrangement shown in FIG. 7, three different angles are presented to the insulating glass designer. These angles are denoted A, B, and C. In A and C, muntin bars 70 must be joined together and then secured against the spacer bar of the insulating glass window 68. At location B, a single end of muntin bar 70 must be secured against the spacer bar. Typically, each of these locations has required a different sort of insert. Often, especially at location B, the insert had to be modified and trimmed on the field to accomplish the desired objective.

Through the present invention, each of the locations shown in FIG. 7 is well served by a single stabilizer. The stabilizer 10 of FIG. 1 is suitable for locations A and C and is schematically shown enlarged for clarity. The primary insert 12 is inserted in one of the muntin bars 70 while the secondary insert 14 is inserted in the other. The relative location of the primary insert 12 to the secondary insert 14 is adjusted by rotating secondary insert 14 around pivot point 16. The pad 30 is adjusted by means of the neck 32 to fit parallel and adjacent to the adjacent spacer bar. At location B, the secondary insert 14 is removed from the primary insert 12 and a single primary insert 12 is inserted into the single open end of the muntin bar 70. The pad 30 is then adjusted to the appropriate angle desired.

The invention has been described with reference to preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A stabilizer for securing muntin bar within associated insulating glass windows contained within a frame, the stabilizer comprising:

a primary insert having first and second ends and having a centerline;

a secondary insert having first and second ends, the first end of the secondary insert being connected to the first end of the primary insert;

a pad for selectively positioning the muntin bar against a spacer bar of the associated insulating glass window, the pad lying in a pad plane;

attaching means for attaching the pad to the first end of the primary insert.

2. The stabilizer of claim 1 wherein the angle of the pad plane relative to the centerline of the primary insert is adjustable.

3. The stabilizer of claim 2 wherein the plane of the muntin bar, the angle of the pad plane varying from 0° to 360°.

4. The stabilizer of claim 1 wherein the attaching means is a neck, the neck being more easily deformable in the plane of associated muntin bars than in other directions.

5. The stabilizer of claim 4 wherein the neck is generally plastically deformable, so that the pad tends to retain the position to which it has been deformed.

6. The stabilizer of claim 1 wherein the stabilizer is made of nylon.

7. The stabilizer of claim 1 wherein the second end of the periphery insert comprises a pair of bowed legs, the bowed legs each having a knee which, when inserted within a piece of associated muntin bar, presses against the interior of the associated muntin bar.

8. A stabilizer for securing muntin bar within insulating glass windows, the stabilizer comprising:

a primary insert having first and second ends;

a secondary insert having first and second ends, the first end of the secondary insert being connected to the first end of the primary insert;

a pad; and, attaching means for attaching the pad to the first end of the primary insert, the first end of the primary insert having a pivot hole and the first end of the secondary insert having a pivot post, the pivot post rotatably received within the pivot hole.

9. The stabilizer of claim 8 wherein the pivot post terminates in a ledge, the ledge selectively received within a slot in the pivot hole, whereby the pivot post is secured to the pivot hole.

10. A stabilizer for securing muntin bar within insulating glass windows, the stabilizer comprising:

a primary insert having first and second ends;

a secondary insert having first and second ends, the first ends of the secondary insert being connected to the first end of the primary insert, the secondary insert being selectively removable from the primary insert;

a pad; and, attaching means for attaching the pad to the first end of the primary insert.

11. A stabilizer for securing muntin bar between a pair of panes of an associated insulating glass window, the stabilizer comprising:

a primary insert having first and second ends and having a center line, the second end having insertion means for securing the body within an associated muntin bar;

a pad, the pad lying in a plane, opposite sides of said pad corresponding to a width between the associated panes of the associated insulating glass window; and, attaching means for attaching the pad to the first end of the body.

12. The stabilizer of claim 11 wherein the angle of the pad plane relative to the centerline of the primary insert is adjustable.

13. The stabilizer of claim 11 wherein the insertion means comprises a pair of outwardly extending legs, each leg having a knee and a toe, the knees being adapted to lie adjacent the interior walls of an associated muntin bar and secure the stabilizer within the muntin bar , the toes extending less outwardly than the knees and being arrow-shaped to aid insertion of the stabilizer within the muntin bar.

14. A stabilizer for securing muntin bar within insulating glass windows, the stabilizer having a pad and comprising:

a body having a first end and a second end, the first end having a flat face, the flat face making an angle between 10° and 45° with a longitudinal axis of the stabilizer, the second end having insertion means for securing the body within an associated muntin bar; and, attaching means for attaching the pad to the first end of the body.

15. A stabilizer for securing muntin bar within insulating glass windows, the stabilizer comprising:

a body having a first end and a second end, the second end having insertion means for securing the body within an associated muntin bar;

a pad, the pad lying in a plane which makes an angle between 10° and 45° with a longitudinal axis of the stabilizer; and, attaching means for attaching the pad to the first end of the body.

16. A stabilizer for securing muntin bar within insulating glass windows, the stabilizer comprising:

a body having a first end and a second end, the second end having insertion means for securing the body within an associated muntin bar;

a pad; and, attaching means for attaching the pad to the first end of the body, the attaching means being a neck, the neck having a thickness and a length, the length being between 5 and 20 times the thickness.

17. A stabilizer for securing muntin bar within insulating glass windows, the stabilizer comprising:

a body having a first end and a second end, the second end having insertion means for securing the body within an associated muntin bar;

a pad; and, attaching means for attaching the pad to the first end of the body, the attaching means being a neck, the neck having a width and a thickness, the thickness of the neck being between 0.020 inches and 0.100 inches.

18. The stabilizer of claim 17 wherein the width is approximately twice the thickness.

19. A method of assembling muntin bar for placement within insulating glass windows, the windows comprising two panes of glass separated by a spacer bar, the method comprising the steps of:

fixing individual pieces of muntin bar into the desired arrangement;

inserting a stabilizer within an end of the muntin bars which will eventually be adjacent an associated spacer bar, each stabilizer having a pad and a centerline the pad having a width approximately equal to the distance between two panes of an associated insulating glass window, the pad lying in a plane, the plane making an angle with said centerline; and adjusting said angle of said plane containing said pad so that it lies parallel and adjacent to the spacer bar upon insertion of the muntin bar within the window.

20. A method of assembling muntin bar into a diamond-shaped arrangement for placement within insulating glass windows, the windows comprising two panes of glass separated by a spacer bar, the method comprising the steps of:

fixing the individual pieces of muntin into a diamond-shaped arrangement;

inserting a stabilizer into each large angle junction of the muntin bars, the stabilizer comprising a primary and secondary insert with an adjustable pad adjustably fixed to one end of the primary insert;

inserting said stabilizer into each small angle of the muntin bars;

inserting said primary insert into each single end of the muntin bar; and, adjusting the angle of each pad so that it lies parallel to the portion of the spacer bar to which it will be adjacent upon insertion of the muntin bars within the window.

* * * * *

UNITED STATES PATENT AND TRADEMARK OFFICE

CERTIFICATE OF CORRECTION

PATENT NO. : 5,154,034

DATED : October 13, 1992

INVENTOR(S) : Ronald F. Stanek

It is certified that error appears in the above-identified patent and that said Letters Patent is hereby corrected as shown below:

Claim 3, column 6, line 21, after "wherein the" insert --attaching means allows adjustment of the pad within the--.

Claim 7, column 6, line 34, delete "periphery" and replace with --primary--.

Claim 10, column 6, line 58, after "first" delete "ends" and replace with --end--.

Claim 19, column 8, line 25, before "the" insert --,--.

Claim 20, column 8, line 44, after "angle" insert --junction--.

Signed and Sealed this

Fourteenth Day of September, 1993

Bruce Lehman

*Attest:*

BRUCE LEHMAN

*Attesting Officer*

*Commissioner of Patents and Trademarks*